US011668290B1

(12) United States Patent
Wu

(10) Patent No.: US 11,668,290 B1
(45) Date of Patent: Jun. 6, 2023

(54) FLOOR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 0 days.

(21) Appl. No.: 17/672,868

(22) Filed: Feb. 16, 2022

(51) Int. Cl.
*F04B 33/00* (2006.01)

(52) U.S. Cl.
CPC ..... *F04B 33/005* (2013.01)

(58) Field of Classification Search
CPC ..... F04B 33/00–005
See application file for complete search history.

(56) References Cited

U.S. PATENT DOCUMENTS

2007/0264143 A1* 11/2007 Chuang ..... F04B 33/005
417/559

* cited by examiner

*Primary Examiner* — Thomas Fink
(74) *Attorney, Agent, or Firm* — Karin L. Williams; Mayer & Williams PC

(57) ABSTRACT

A floor pump includes a base, a first cylinder, a second cylinder, an air tube, a handle and an air release device. The first cylinder and the air tube unidirectionally communicate with the base. The second cylinder is movably connected within the first cylinder and has a first piston. The air tube is disposed in the second cylinder and has a second piston. The handle is connected to the second cylinder. The air release device is disposed in the handle and includes a switcher and an air release valve assembly configured to be pressed by the switcher to move relative to a through hole of the handle to cause the second cylinder selectively communicates with the outside of the floor pump.

7 Claims, 7 Drawing Sheets

FLOOR PUMP

BACKGROUND

The present invention relates to a floor pump and, more particular, to a floor pump can be adjustable between a high volume mode and a high pressure mode.

A conventional air pump with high pressure and large air output is usually provided with inner and outer cylinders on a base, and a hollow pumping rod disposed between the inner and outer cylinders. One way valves are mounted between a pumping piston at the bottom of the pumping rod, and the inner and outer cylinders, and the inner side of the pumping rod and the top of the inner cylinder, the upper and lower ends of the inner cylinder. The base is respectively provided with channels extending the inner and outer cylinders to an air outlet, each channel is provided with a one-way valve, and the channel corresponding to the outer cylinder is provided with an adjustment component that can control the opening and closing of the channel. Thus, the air pump can inflate with a large air volume, and can also cooperate with the control of the adjustment component to output air with high-pressure.

However, the adjustment component of the air pump is arranged on the base, so that it is not only difficult for the user to switch, but also difficult to observe where the adjustment component is currently located. It is easy to accidentally touch the adjustment component when inflating, so it is necessary to improve it.

SUMMARY

An objective of the present invention is to provide a floor pump, which includes a base, a first cylinder, a second cylinder, an air tube, a handle, an air release device, and a hose. The base has an air passage. The first cylinder is mounted on the base and unidirectionally communicates with the air passage. The second cylinder is movably connected within the first cylinder, and an end of the second cylinder has a first piston configured to compress the air in the first cylinder. The air tube is disposed in the second cylinder and penetrates through the first piston. The air tube communicates with the second cylinder and unidirectionally communicates with the air passage. An end of the air tube is mounted on the base and another end of the air tube has a second piston configured to compress the air in the second cylinder. The handle is connected to an end of the second cylinder opposite to the first piston and has a receiving portion and a through hole. The receiving portion communicates with the through hole and the outside of the floor pump, and the through hole selectively communicates with the second cylinder. The air release device includes a switcher and an air release valve assembly. The switcher is rotatably disposed in the receiving portion and abuts against the air release valve assembly. The air release valve assembly is disposed in the through hole and configured to be pressed by the switcher to move relative to the through hole to cause the second cylinder selectively communicates with the outside of the floor pump. The hose is mounted on the base and communicates with the air passage, and the hose is adapted for connecting with an inflatable object.

In an embodiment, the switcher has a first positioning portion and a second positioning portion. The first positioning portion and the second positioning portion are configured to selectively abut the air release valve assembly as the switcher rotates relative to the receiving portion. A height difference is formed between the first positioning portion and the second positioning portion. When the first positioning portion abuts against the air release valve assembly, the air release valve assembly closes the through hole, so that the second cylinder and the receiving portion are not communicate with each other. When the second positioning portion abuts the air release valve assembly, the air release valve assembly moves relative to the through hole to form a gap to cause the second cylinder, the through hole, the receiving portion, and the outside of the floor pump are communicated with each other.

In an embodiment, the air release valve assembly includes a sealing member and a first biasing member. The sealing member is movably disposed in the through hole. An end of the sealing member has a sealing portion and another end of the sealing member has an abutting portion. The sealing member is configured to close the through hole. The abutting portion is selectively abutted against the first positioning portion or the second positioning portion. The first biasing member is sleeved around the sealing member to bias against the sealing member. When the first positioning portion abuts against the abutting portion, the sealing member to closes the through hole. When the second positioning portion abuts against the abutting portion, the sealing member moves relative to the through hole and compresses the first biasing member to form the gap between the sealing portion and the through hole.

In an embodiment, the through hole includes a small diameter section communicating with the second cylinder, a large diameter section communicating with the receiving portion, and a shoulder portion formed between the small diameter section and the large diameter section. The sealing portion selectively abuts against the small diameter section to close the through hole, and two opposite ends of the first biasing member are respectively abut against the abutting portion and the shoulder portion.

In an embodiment, the switcher further has a toggle portion formed on an outer periphery of the switcher, and a mounting portion extending from an end face of the switcher. The first positioning portion and the second positioning portion are formed on the end face of the switcher, and the air release device further includes a fastener engaged with the mounting portion.

In an embodiment, the handle has a containing hole extending parallel to the through hole. The switcher further has at least one positioning recess formed on the end face of the switcher. The air release device further includes an abutting assembly arranged in the containing hole and abutting between the handle and the at least one positioning recess.

In an embodiment, the abutting assembly includes an abutting member and a second biasing member. The abutting member is selectively abutted against the at least one positioning recess, and the second biasing member biases the abutting member toward the switcher.

The present invention will become clearer in light of the following detailed description of illustrative embodiments of this invention described in connection with the drawings.

DETAILED DESCRIPTION

Figure 1:
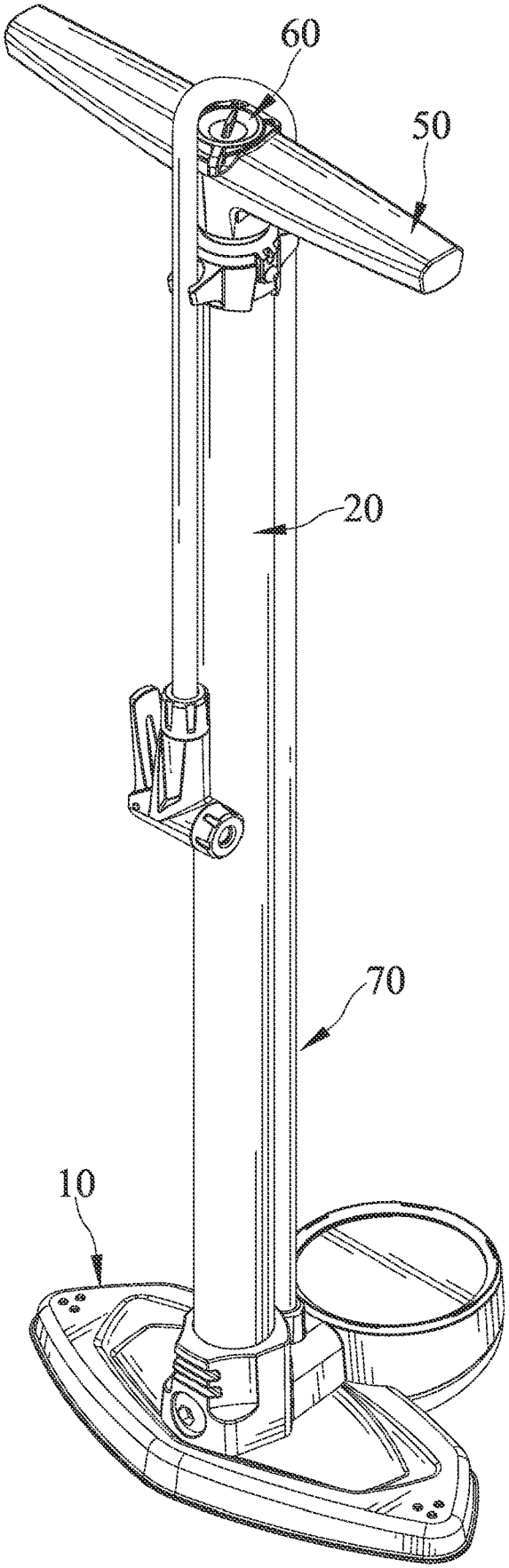
FIG. 1 is a perspective view of a floor pump of an embodiment according to the present invention.
Figure 2:
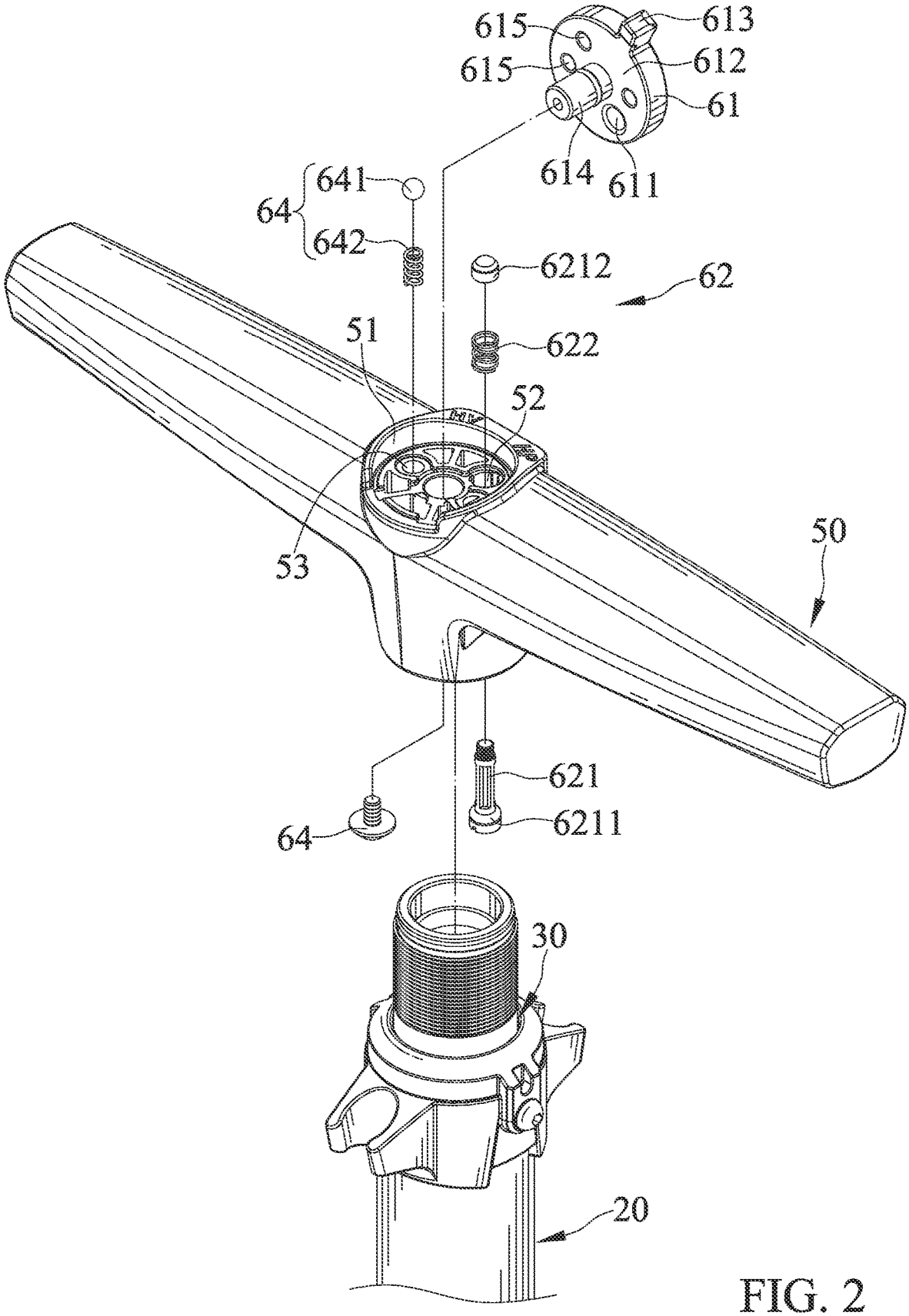
FIG. 2 is a partial exploded perspective view of the floor pump of FIG. 1.
Figure 3:
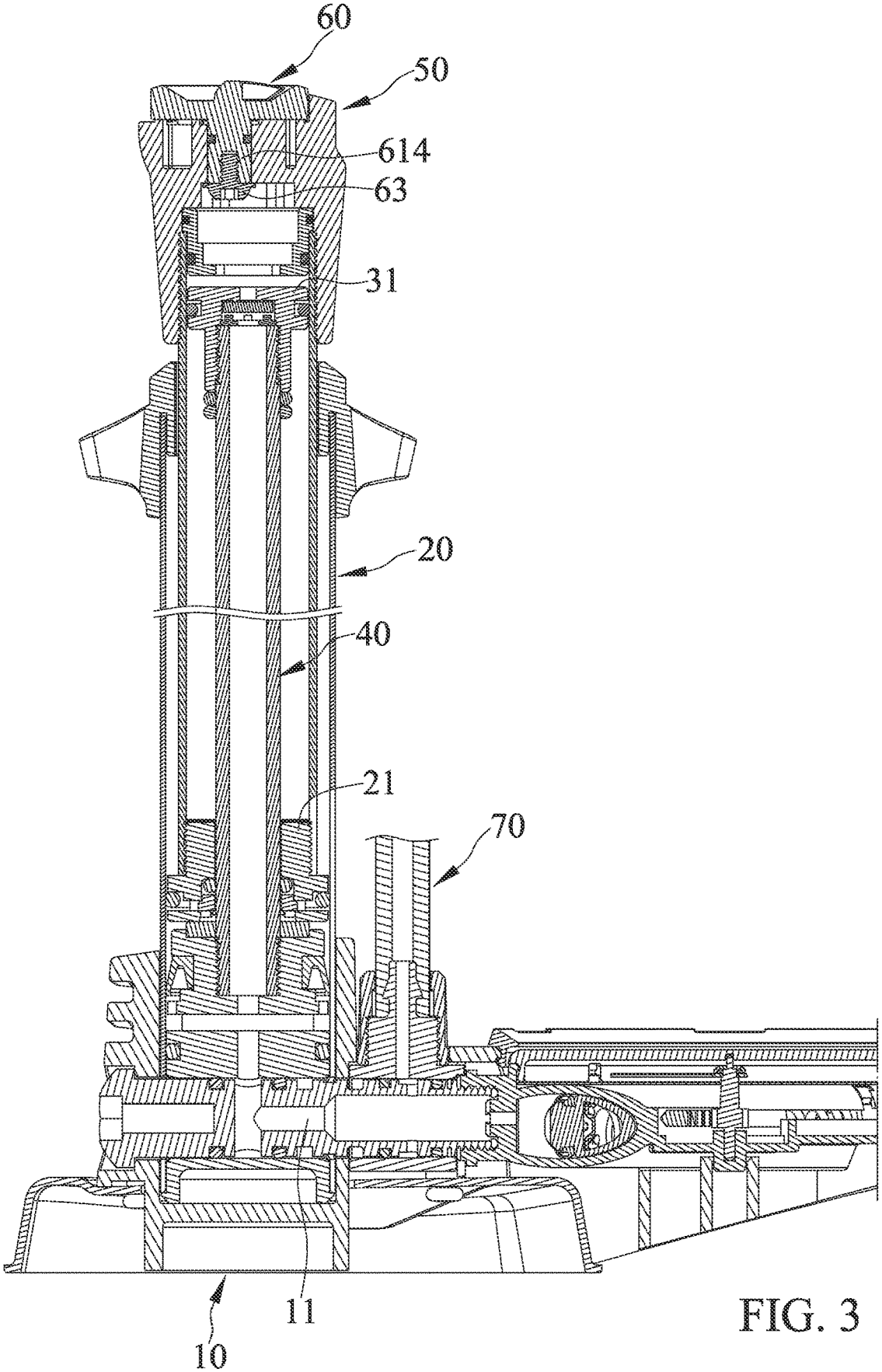
FIG. 3 is a cross sectional view of the floor pump of FIG. 1.
Figure 4:
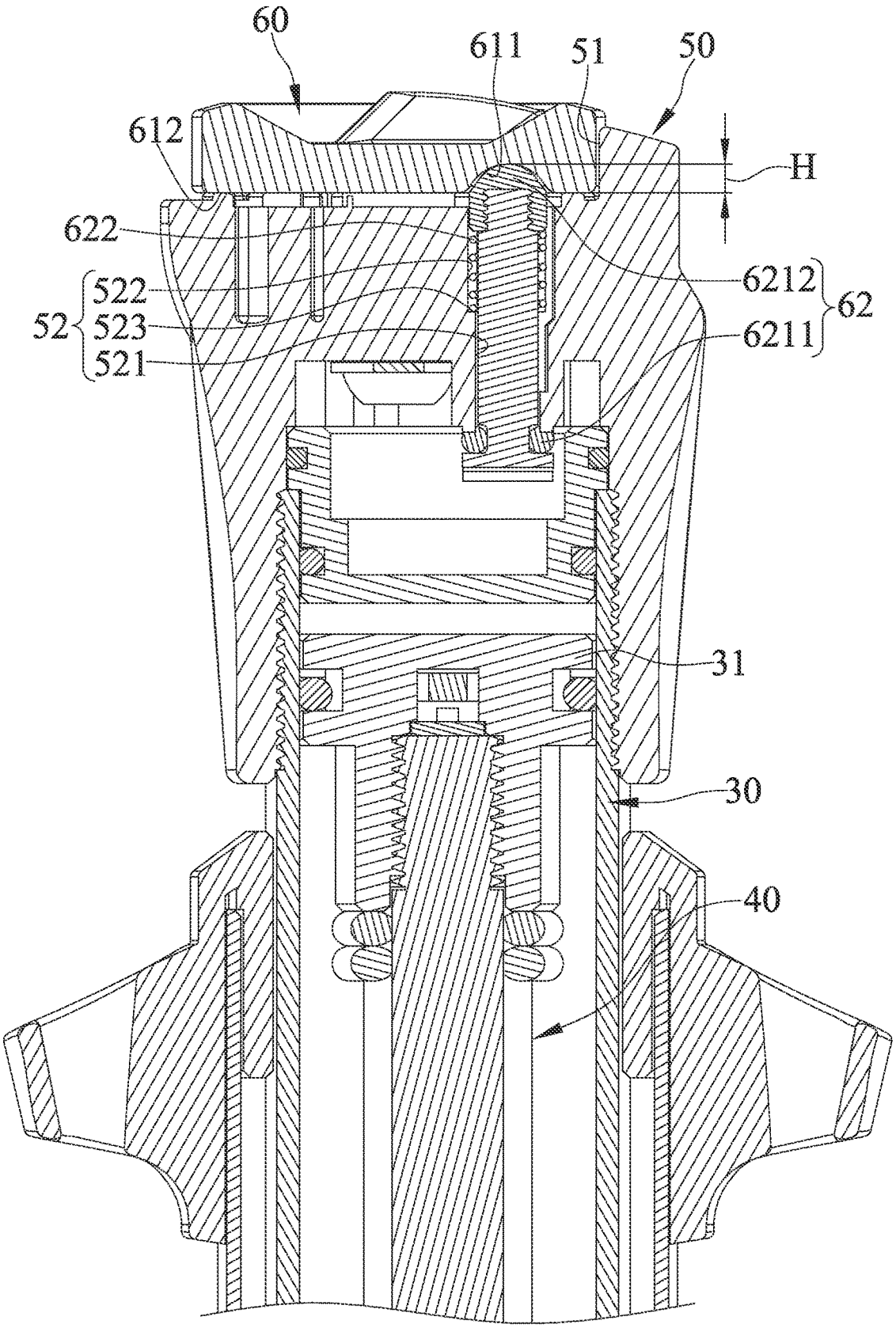
FIGS. 4 and 5 are cross sectional views of the floor pump of FIG. 1, and show a switcher in a first position.

FIGS. 1-7 show a floor pump of an embodiment according to the present invention. The floor pump includes a base 10, a first cylinder 20, a second cylinder 30, an air tube 40, a handle 50, an air release device 60, and a hose 70.

The base 10 can be placed on a plane and has an air passage 11. The first cylinder 20 is mounted on the base 10 and unidirectionally communicates with the air passage 11. The second cylinder 30 is axially movably connected within the first cylinder 20. An end of the second cylinder 30 has a first piston 21 configured to compress the air in the first cylinder 20. The air tube 40 is disposed in the second cylinder 30 and penetrates through the first piston 21. The air tube 40 communicates with the second cylinder 30 and unidirectionally communicates with the air passage 11. An end of the air tube 40 is mounted on the base 10 and another end of the air tube 40 has a second piston 31 configured to compress the air in the second cylinder 30. The hose 70 is mounted on the base 10 and communicates with the air passage 11, and the hose 70 is adapted for connecting with an inflatable object (not shown).

The handle 50 is connected to an end of the second cylinder 30 opposite to the first piston 21. The handle 50 has a receiving portion 51, a through hole 52 and a containing hole 53. The receiving portion 51 is formed on a top face of the handle 50 and communicates with the through hole 52 and the outside of the floor pump. The through hole 52 selectively communicates with the second cylinder 30 and includes a small diameter section 521 communicating with the second cylinder 30, a large diameter section 522 communicating with the receiving portion 51, and a shoulder portion 523 formed between the small diameter section 521 and the large diameter section 522. The containing hole 53 extends parallel to the through hole 52.

The air release device 60 includes a switcher 61, an air release valve assembly 62, a fastener 63 and an abutting assembly 64. The switcher 61 is rotatably disposed in the receiving portion 51 and abuts against the air release valve assembly 62, so that the switcher 61 can rotate relative to the receiving portion 51 and switch between a first position and a second position. The switcher 61 has a first positioning portion 611, a second positioning portion 612, a toggle portion 613, a mounting portion 614 and at least one positioning recess 615. The first positioning portion 611, the second positioning portion 612, the mounting portion 614 and the at least one positioning recess 615 are formed on an end face of the switcher 61. The first positioning portion 611 and the second positioning portion 612 are configured to selectively abut the air release valve assembly 62 as the switcher 61 rotates relative to the receiving portion 51. A height difference H is formed between the first positioning portion 611 and the second positioning portion 612. The toggle portion 613 is formed on an outer periphery of the switcher 61 and slightly protrudes out of the handle 50 to provided a user to toggle and rotate the switcher 61 relative to the handle 50. The mounting portion 614 extends from the end face of the switcher 61. Further, the mounting portion 614 is formed at a center portion of the end face of the switcher 61. The switcher 61 in the embodiment is provided with two positioning recesses 615 spaced each other in a circumferential direction of the switcher 61.

The air release valve assembly 62 is disposed in the through hole 52 and configured to be pressed by the switcher 61 to move relative to the through hole 52 to cause the second cylinder 30 selectively communicates with the outside of the floor pump. The air release valve assembly 62 includes a sealing member 621 and a first biasing member 622. The sealing member 621 is movably disposed in the through hole 52. An end of the sealing member 621 has a sealing portion 6211 and another end of the sealing member 621 has an abutting portion 6212. The sealing portion 6211 is configured to selectively abut against the small diameter section 521 to close the through hole 52. The abutting portion 6212 is selectively abutted against the first positioning portion 611 or the second positioning portion 612. The first biasing member 622 is sleeved around the sealing member and two opposite ends of the first biasing member 622 are respectively abut against the abutting portion 6212 and the shoulder portion 523 to bias against the sealing member 621.

The fastener 63 is engaged with the mounting portion 614. Further, the fastener 63 and the mounting portion 614 may be threaded connected each other, that is, the fastener 63 can be a screw, and the mounting position 614 is provided with a screw hole corresponding to the screw, so that the switcher 61 can be rotated relative to the handle 50 to change between the first position and the second position, and cannot be detached from the receiving portion 51.

The abutting assembly 64 is arranged in the containing hole 53 and abuts between the handle 50 and one of the two positioning recesses 615. The abutting assembly 64 includes an abutting member 641 and a second biasing member 642. The abutting member 641 is selectively abutted against one of the two positioning recesses 615. The second biasing member biases the abutting member 641 toward the switcher 61. Thus, the abutting assembly 64 provides a positioning effect when the switcher 61 is changed between the first position and the second position.

Figure 5:
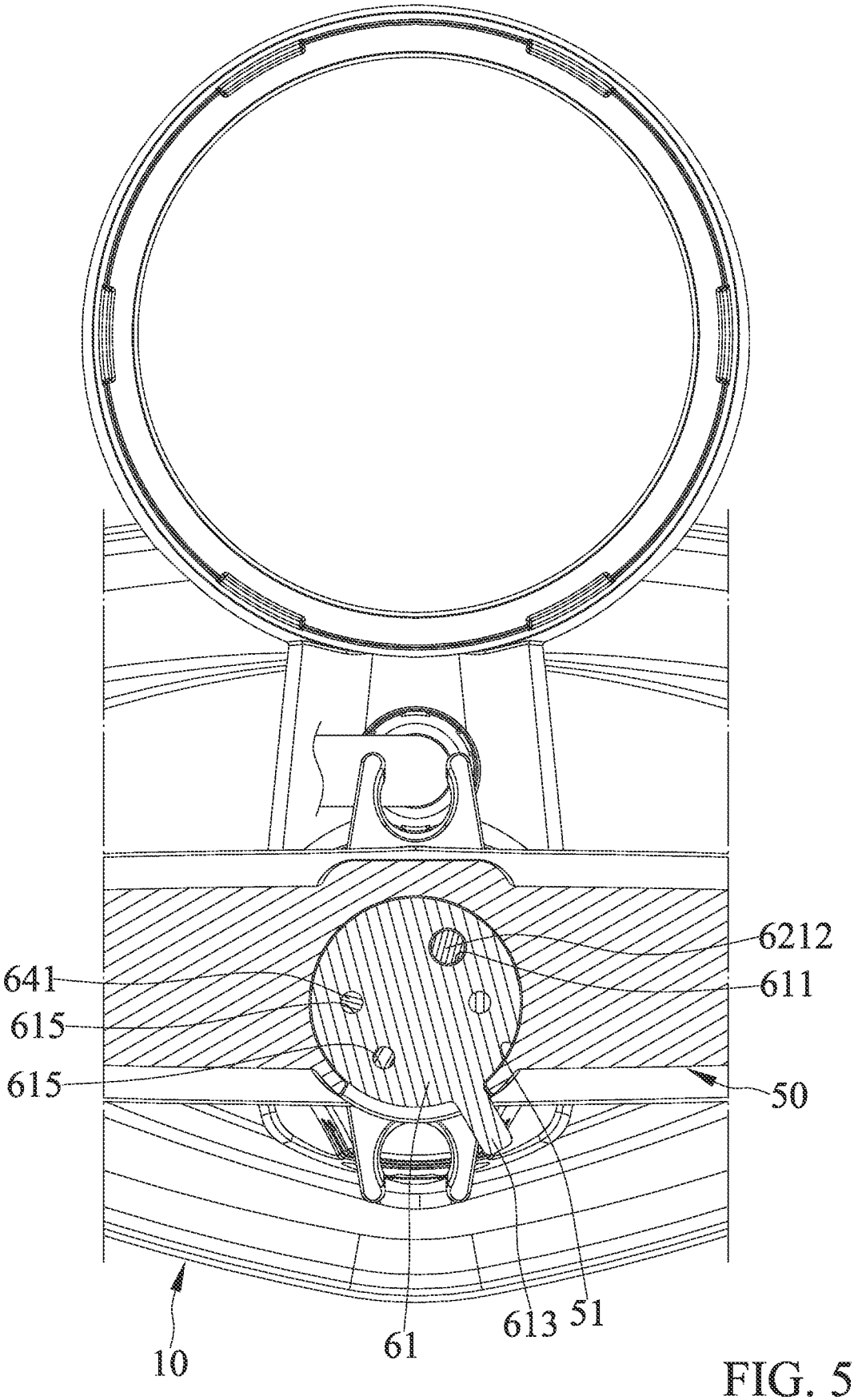
Figure 6:
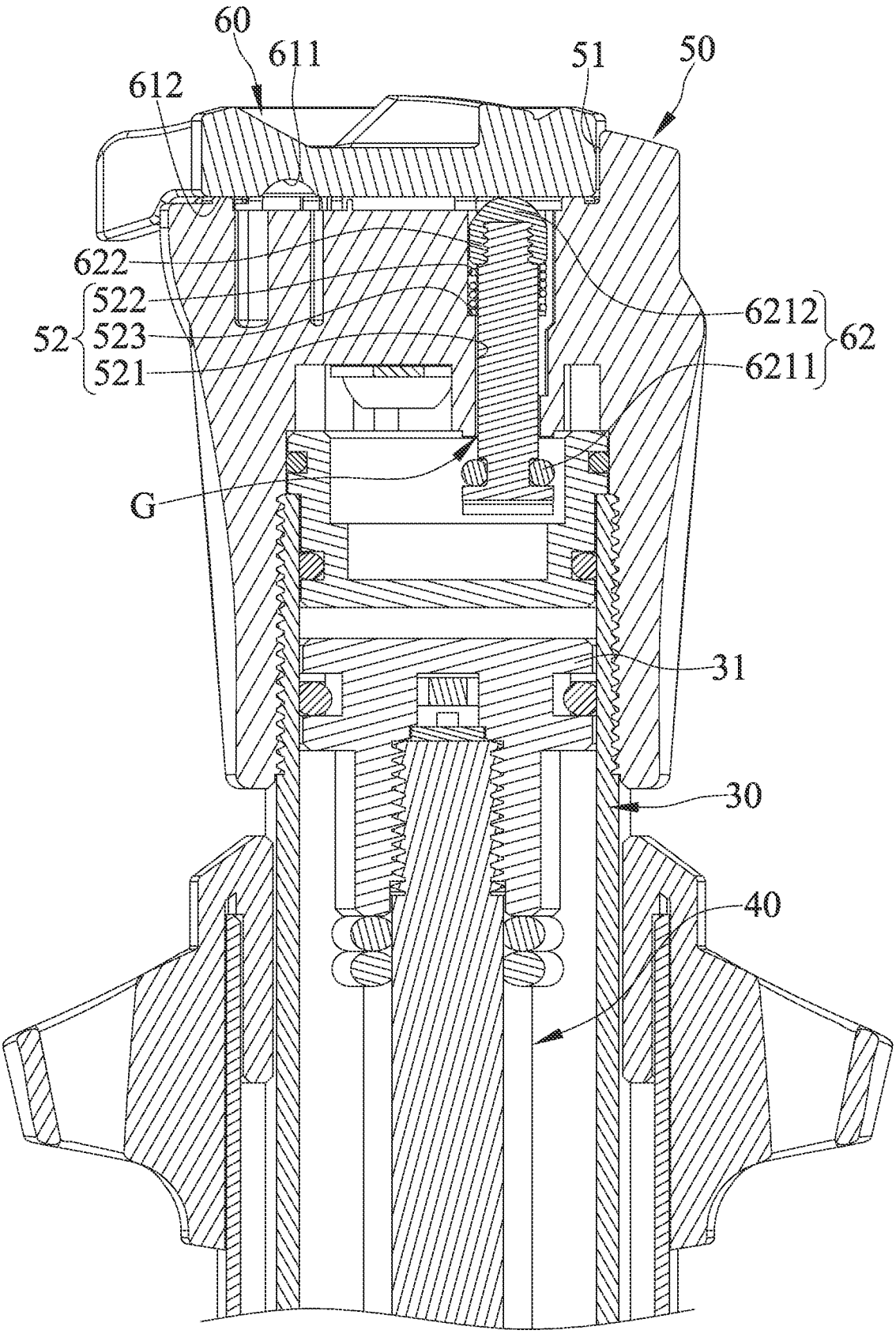
FIGS. 6 and 7 are cross sectional views of the floor pump of FIG. 1, and show the switcher in a second position.

When the switcher 61 is in the first position, the abutting member 641 of the abutting assembly 64 is abutted against one of the two positioning recesses 615 (as shown in FIG. 5), the first positioning portion 611 abuts against the abutting portion 6212 of the sealing member 621, and the sealing portion 6211 of the sealing member 621 closes the through hole 52, so that the second cylinder 30, the through hole 52, the receiving portion and the outside of the floor pump are not communicate with each other. In other words, the second cylinder 30 is isolated from the outside of the floor pump, so when the second cylinder 30 moves axially relative to the first cylinder 20, both the first piston 21 and the second piston 31 can compress the air in the first cylinder 20 and the second cylinder 30, respectively. The compressed air from the first cylinder 20 and the second cylinder 30 enters the air passage 11 unidirectionally, and the compressed air after entering the air passage 11 enters the inflatable object via the hose 70. Therefore, the first piston 21 and the second piston 31 each perform work on the air in the first cylinder 20 and the second cylinder 30, thereby performing low-pressure and high-volume inflating.

Figure 7:
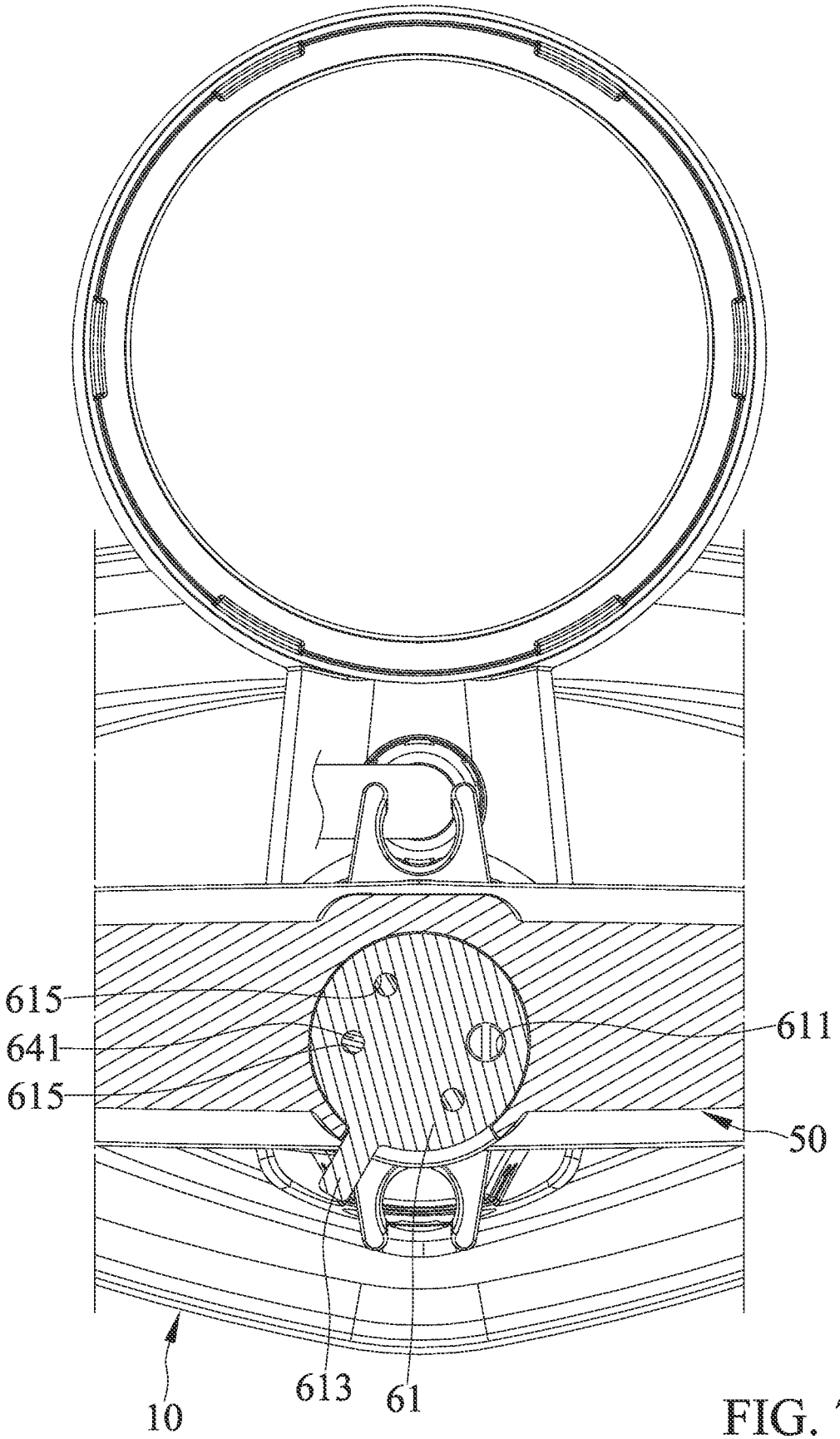

The user can toggle the toggle portion 613 of the switcher 61 to rotate the switcher 61 relative to the receiving portion 51 to switch from the first position to the second position. When the switcher 61 is in the second position, the abutting member 641 of the abutting assembly 64 is abutted against another one of the two positioning recesses 615 (as shown in FIG. 7), and the second positioning portion 612 abuts against the abutting portion 6212 of the sealing member 621. Since there is a height difference H between the first positioning portion 611 and the second positioning portion 612, the sealing member 621 moves relative to the through hole 52 when abutted by the second positioning portion 612 to compresses the first biasing member 622 to form a gap G between the small diameter sections 521 of the through hole 52 and the sealing portion 6211 of the sealing member 621 to cause the second cylinder 30, the through hole 52, the receiving portion 51, and the outside of the floor pump are communicated with each other, so when the second cylinder 30 moves axially relative to the first cylinder 20, the second piston 31 cannot compress the air in the second cylinder 30, and only the first piston 21 can compress the first cylinder 20. The compressed air from the first cylinder 20 enters the air passage 11 unidirectionally and enters the inflatable object via the hose 70. Therefore, only the first piston 21 performs work on the air in the first cylinder 20, thereby performing high-pressure and low-volume inflating.

Thus, the switcher 61 can be rotated relative to the receiving portion 51 of the handle 50 to switch between the first position and the second position. The through hole 52 of the handle 50 selectively communicates with the second cylinder 30 to selectively communicate or isolate the second cylinder 30 from the outside, so the second piston 31 can selectively perform work on the air in the second cylinder 30 to achieve the purpose of changing the pressure, That is, the user can choose high-volume inflation or high-pressure inflation according to the needs of use.

In addition, since the switcher 61 is rotatably disposed on the handle 50, the user can easily operate the switcher 61, and can clearly identify the current position of the switcher 61. There will be no accidental touch of the switcher 61 when inflating.

Although specific embodiments have been illustrated and described, numerous modifications and variations are still possible without departing from the scope of the invention. The scope of the invention is limited by the accompanying claims.

The invention claimed is:

1. A floor pump comprising:

a base having an air passage;

a first cylinder mounted on the base and unidirectionally communicating with the air passage;

a second cylinder movably connected within the first cylinder, and wherein an end of the second cylinder has a first piston configured to compress the air in the first cylinder;

an air tube disposed in the second cylinder and penetrating through the first piston, wherein the air tube communicates with the second cylinder and unidirectionally communicates with the air passage, and wherein an end of the air tube is mounted on the base and another end of the air tube has a second piston configured to compress the air in the second cylinder;

a handle connected to an end of the second cylinder opposite to the first piston, wherein the handle has a receiving portion and a through hole, wherein the receiving portion communicates with the through hole and the outside of the floor pump, and wherein the through hole selectively communicates with the second cylinder;

an air release device including a switcher and an air release valve assembly, wherein the switcher is rotatably disposed in the receiving portion and abuts against the air release valve assembly, wherein the air release valve assembly is disposed in the through hole and configured to be pressed by the switcher to move relative to the through hole to cause the second cylinder selectively communicates with the outside of the floor pump; and a hose mounted on the base and communicating with the air passage, and wherein the hose is adapted for connecting with an inflatable object.

2. The floor pump as claimed in claim 1, wherein the switcher has a first positioning portion and a second positioning portion, wherein the first positioning portion and the second positioning portion are configured to selectively abut the air release valve assembly as the switcher rotates relative to the receiving portion, wherein a height difference is formed between the first positioning portion and the second positioning portion;

when the first positioning portion abuts against the air release valve assembly, the air release valve assembly closes the through hole, so that the second cylinder and the receiving portion are not communicate with each other;

when the second positioning portion abuts the air release valve assembly, the air release valve assembly moves relative to the through hole to form a gap to cause the second cylinder, the through hole, the receiving portion, and the outside of the floor pump are communicated with each other.

3. The floor pump as claimed in claim 2, wherein the air release valve assembly includes a sealing member and a first biasing member, wherein the sealing member is movably disposed in the through hole, wherein an end of the sealing member has a sealing portion and another end of the sealing member has an abutting portion, wherein the sealing member is configured to close the through hole, wherein the abutting portion is selectively abutted against the first positioning portion or the second positioning portion, and wherein the first biasing member is sleeved around the sealing member to bias against the sealing member;

when the first positioning portion abuts against the abutting portion, the sealing member to closes the through hole;

when the second positioning portion abuts against the abutting portion, the sealing member moves relative to the through hole and compresses the first biasing member to form the gap between the sealing portion and the through hole.

4. The floor pump as claimed in claim 3, wherein the through hole includes a small diameter section communicating with the second cylinder, a large diameter section communicating with the receiving portion, and a shoulder portion formed between the small diameter section and the large diameter section, wherein the sealing portion selectively abuts against the small diameter section to close the through hole, and wherein two opposite ends of the first biasing member are respectively abut against the abutting portion and the shoulder portion.

5. The floor pump as claimed in claim 3, wherein the switcher further has a toggle portion formed on an outer periphery of the switcher, and a mounting portion extending from an end face of the switcher, wherein the first positioning portion and the second positioning portion are formed on the end face of the switcher, and wherein the air release device further includes a fastener engaged with the mounting portion.

6. The floor pump as claimed in claim 5, wherein the handle has a containing hole extending parallel to the through hole, wherein the switcher further has at least one positioning recess formed on the end face of the switcher, wherein the air release device further includes an abutting assembly arranged in the containing hole and abutting between the handle and the at least one positioning recess.

7. The floor pump as claimed in claim 6, wherein the abutting assembly includes an abutting member and a second biasing member, wherein the abutting member is selectively abutted against the at least one positioning recess, and wherein the second biasing member biases the abutting member toward the switcher.

* * * * *